US010017917B2

(12) United States Patent
Kawaguchi et al.

(10) Patent No.: US 10,017,917 B2
(45) Date of Patent: Jul. 10, 2018

(54) DRIVE DEVICE OF CONSTRUCTION MACHINE

(71) Applicant: Komatsu Ltd., Tokyo (JP)

(72) Inventors: Tadashi Kawaguchi, Hiratsuka (JP); Teruo Akiyama, Kokubunji (JP); Koji Saito, Fujisawa (JP); Takayuki Watanabe, Hiratsuka (JP); Noboru Iida, Chigasaki (JP)

(73) Assignee: Komatsu Ltd., Tokyo (JP)

( * ) Notice: Subject to any disclaimer, the term of this patent is extended or adjusted under 35 U.S.C. 154(b) by 185 days.

(21) Appl. No.: 14/916,368

(22) PCT Filed: Oct. 28, 2015

(86) PCT No.: PCT/JP2015/080453

§ 371 (c)(1),
(2) Date: Mar. 3, 2016

(87) PCT Pub. No.: WO2016/056675

PCT Pub. Date: Apr. 14, 2016

(65) Prior Publication Data

US 2017/0121940 A1 May 4, 2017

(51) Int. Cl.

| | |
|---|---|
| ***F16D 31/02*** | (2006.01) |
| ***E02F 9/22*** | (2006.01) |
| ***F15B 11/16*** | (2006.01) |
| ***E02F 3/32*** | (2006.01) |

(Continued)

(52) U.S. Cl.

CPC ..... *E02F 9/22* (2013.01); *E02F 3/32* (2013.01); *E02F 3/435* (2013.01); *E02F 9/123* (2013.01);

(Continued)

(58) Field of Classification Search

CPC ..... F15B 11/163; F15B 11/17; E02F 9/2075; E02F 9/2242; E02F 9/2282; E02F 9/2292

(Continued)

(56) References Cited

U.S. PATENT DOCUMENTS 4,561,341 A * 12/1985 Aikawa ..... E02F 9/2292 60/484

5,852,934 A 12/1998 Chung et al.

(Continued)

FOREIGN PATENT DOCUMENTS

CN 1156201 A 8/1997
CN 1160823 A 10/1997

(Continued)

OTHER PUBLICATIONS

International Search Report and Written Opinion dated Jan. 19, 2016, issued for PCT/JP2015/080453.

*Primary Examiner* — Michael Leslie
(74) *Attorney, Agent, or Firm* — Locke Lord LLP

(57) ABSTRACT

A drive device of a construction machine includes a pump passage connected to a hydraulic pump, first and second supply passages connected to the pump passage, first and second passages connected to the first supply passage, third and fourth passages connected to the second supply passage, a first valve connected to the first and third passages, a second valve connected to the second and fourth passages, a first bucket passage connecting the first passage to a cap-side space of the bucket cylinder through the first valve, a second bucket passage connecting the third passage to a rod-side space of the bucket cylinder through the first valve, a first arm passage connecting the second passage to a rod-side space of an arm cylinder through the second valve, and a second arm passage connecting the fourth passage to a cap-side space of the arm cylinder through the second valve.

8 Claims, 7 Drawing Sheets

(51) Int. Cl.

| | |
|---|---|
| ***E02F 9/12*** | (2006.01) |
| ***F15B 11/08*** | (2006.01) |
| ***F15B 13/04*** | (2006.01) |
| ***F15B 21/08*** | (2006.01) |
| ***E02F 3/43*** | (2006.01) |
| ***E02F 9/20*** | (2006.01) |
| ***F15B 11/17*** | (2006.01) |

(52) U.S. Cl.
CPC ..... *E02F 9/2095* (2013.01); *E02F 9/2217* (2013.01); *E02F 9/2228* (2013.01); *E02F 9/2242* (2013.01); *E02F 9/2292* (2013.01); *E02F 9/2296* (2013.01); *F15B 11/08* (2013.01); *F15B 11/163* (2013.01); *F15B 11/17* (2013.01); *F15B 13/0401* (2013.01); *F15B 21/08* (2013.01); *F15B 2211/20523* (2013.01); *F15B 2211/20576* (2013.01); *F15B 2211/30595* (2013.01); *F15B 2211/35* (2013.01); *F15B 2211/7135* (2013.01); *F15B 2211/7142* (2013.01)

(58) Field of Classification Search
USPC ..... 60/420, 421, 484, 486
See application file for complete search history.

(56) References Cited

U.S. PATENT DOCUMENTS

| | | | | |
|---|---|---|---|---|
| 5,857,330 | A | 1/1999 | Ishizaki et al. | |
| 5,890,303 | A | 4/1999 | Ishikawa et al. | |
| 6,851,207 | B2 | 2/2005 | Yoshimatsu | |
| 7,069,674 | B2 * | 7/2006 | Arii | E02F 9/2292 60/422 |
| 7,520,130 | B2 | 4/2009 | Tanaka et al. | |
| 7,562,472 | B2 | 7/2009 | Tozawa et al. | |
| 8,572,957 | B2 * | 11/2013 | Ikeda | E02F 9/2292 60/421 |
| 8,607,557 | B2 * | 12/2013 | Ikeda | E02F 9/2242 60/421 |
| 9,151,019 | B2 | 10/2015 | Ono et al. | |
| 9,512,596 | B2 | 12/2016 | Kang et al. | |
| 2003/0132729 | A1 | 7/2003 | Yoshimatsu | |
| 2007/0125078 | A1 | 6/2007 | Tanaka et al. | |
| 2009/0077837 | A1 | 3/2009 | Tozawa et al. | |
| 2012/0167561 | A1 | 7/2012 | Ono et al. | |
| 2013/0291531 | A1 | 11/2013 | Kang et al. | |
| 2015/0354172 | A1 | 12/2015 | Hijikata et al. | |

FOREIGN PATENT DOCUMENTS

| | | | |
|---|---|---|---|
| CN | 1878963 | A | 12/2006 |
| CN | 103282585 | A | 9/2013 |
| CN | 104919190 | A | 9/2015 |
| JP | 58-118307 | A | 7/1983 |
| JP | 03-260401 | A | 11/1991 |
| JP | 08-002269 | A | 1/1996 |
| JP | 2006-336306 | A | 12/2006 |
| KP | 10-2012-0053031 | A | 5/2012 |
| KR | 100517849 | B1 | 10/2005 |
| WO | WO-2005/047709 | A1 | 5/2005 |

* cited by examiner

DRIVE DEVICE OF CONSTRUCTION MACHINE

FIELD

The present invention relates to a drive device of a construction machine.

BACKGROUND

A construction machine such as an excavator includes a working implement with a bucket, an arm, and a boom. The construction machine is equipped with a plurality of hydraulic pumps as a drive source of a hydraulic cylinder for operating the working implement.

Patent Literature 1 discloses a hydraulic circuit including a merging valve for switching a merged state and a divided state for working fluid discharged from a first hydraulic pump and working fluid discharged from a second hydraulic pump. When the first hydraulic pump and the second hydraulic pump are in the merged state, the working fluid discharged from the first hydraulic pump and the working fluid discharged from the second hydraulic pump are merged by the merging valve and are distributed to a plurality of hydraulic cylinders. When the first hydraulic pump and the second hydraulic pump are in the divided state, a boom cylinder is operated by the working fluid discharged from the first hydraulic pump, and a bucket cylinder and an arm cylinder are operated by the working fluid discharged from the second hydraulic pump.

When the working fluid is distributed to the plurality of hydraulic cylinders while the first hydraulic pump and the second hydraulic pump are in the merged state, a phenomenon occurs in which the flow rate of the working fluid supplied to the hydraulic cylinder receiving a small load is larger than the flow rate of the working fluid supplied to the hydraulic cylinder receiving a large load. For that reason, when an operation device is operated so that an operator of the construction machine operates the working implement while the first hydraulic pump and the second hydraulic pump are in the merged state, the working fluid is not supplied to the hydraulic cylinder at the flow rate in response to the operation amount of the operation device, and hence the operability of the operation device is degraded.

Patent Literature 2 discloses a technique in which a pressure compensating valve is provided between a main operation valve and a hydraulic actuator so as to equalize a pre/post-differential pressure of the main operation valve connected to each of a plurality of hydraulic cylinders in the merged state of a first hydraulic pump and a second hydraulic pump. Since each of the main operation valves has a uniform pre/post-differential pressure, the working fluid is supplied to the hydraulic cylinder at the flow rate in response to the operation amount of the operation device, and hence degradation in operability of the operation device is suppressed.

CITATION LIST

Patent Literature

Patent Literature 1: JP 03-260401 A
Patent Literature 2: WO 2005/047709 A

SUMMARY

Technical Problem

When the excavating operation is performed by the working implement of the construction machine, generally, there are many cases in which a high load acts on the bucket cylinder and the arm cylinder compared with the boom cylinder. For that reason, the bucket cylinder and the arm cylinder require the high-pressure working fluid. Meanwhile, the boom cylinder can be driven by the low-pressure working fluid even though a large flow rate of the working fluid is needed. As disclosed in Patent Literature 1, when the bucket cylinder and the arm cylinder are operated by the working fluid discharged from the second hydraulic pump, the high-pressure working fluid needs to be supplied from the second hydraulic pump to the bucket cylinder and the arm cylinder. The high-pressure working fluid discharged from the second hydraulic pump flows through the same passage, is branched at a branch part, and is supplied to each of the bucket cylinder and the arm cylinder. In this case, in the passage in which the high-pressure working fluid flows, the pressure loss of the working fluid increases, and hence hydraulic energy loss occurs.

In Patent Literature 2, since the pressure compensating valve is provided, it is possible to suppress degradation in operability of the operation device when the first hydraulic pump and the second hydraulic pump are in the merged state. However, the boom cylinder is driven by the low-pressure working fluid compared with the bucket cylinder. Regarding the high-pressure working fluid supplied from the hydraulic pump, when the pre/post-differential pressure of the main operation valve connected to the bucket cylinder and the pressure of the working fluid supplied to the main operation valve connected to the boom cylinder are compensated by the pressure compensating valve, the pressure loss caused by the pressure compensating valve increases, and hence hydraulic energy loss occurs.

An object of an aspect of the invention is to provide a drive device of a construction machine capable of suppressing degradation in fuel efficiency caused by the pressure loss generated when a high-pressure working fluid flows.

Solution to Problem

According to a first aspect of the present invention, a drive device of a construction machine including a working implement with a bucket and an arm, comprises: a bucket cylinder which operates the bucket; an arm cylinder which operates the arm; a first hydraulic pump which discharges working fluid supplied to the bucket cylinder and the arm cylinder; and a hydraulic circuit through which the working fluid discharged from the first hydraulic pump flows, wherein the hydraulic circuit includes a first pump passage which is connected to the first hydraulic pump, a first supply passage and a second supply passage which are connected to the first pump passage, a first branch passage and a second branch passage which are connected to the first supply passage, a third branch passage and a fourth branch passage which are connected to the second supply passage, a first main operation valve which is connected to the first branch passage and the third branch passage, a second main operation valve which is connected to the second branch passage and the fourth branch passage, a first bucket passage which connects the first branch passage to a cap-side space of the bucket cylinder through the first main operation valve, a second bucket passage which connects the third branch passage to a rod-side space of the bucket cylinder through the first main operation valve, a first arm passage which connects the second branch passage to a rod-side space of the arm cylinder through the second main operation valve, and a second arm passage which connects the fourth branch passage to a cap-side space of the arm cylinder through the second main operation valve.

According to a second aspect of the present invention, a drive device of a construction machine including a working implement with a bucket, an arm, and a boom, an upper swinging body supporting the working implement, and a lower traveling body, comprises: a generator; an electric swinging motor which is operated by power supplied from the generator so as to generate power for swinging the upper swinging body; a bucket cylinder which operates the bucket; an arm cylinder which operates the arm; a boom cylinder which operates the boom; a first hydraulic pump which discharges working fluid supplied to the bucket cylinder and the arm cylinder; a second hydraulic pump which discharges working fluid supplied to the boom cylinder; and a hydraulic circuit through which the working fluid discharged from the first hydraulic pump and the second hydraulic pump flows, wherein the hydraulic circuit includes a first main operation valve which adjusts a direction and a flow rate of the working fluid supplied from the first hydraulic pump to the bucket cylinder, a second main operation valve which adjusts a direction and a flow rate of the working fluid supplied from the first hydraulic pump to the arm cylinder, and a third main operation valve which adjusts a direction and a flow rate of the working fluid supplied from the second hydraulic pump to the boom cylinder.

Advantageous Effects of Invention

According to the aspect of the invention, it is possible to provide a drive device of a construction machine capable of suppressing degradation in fuel efficiency caused by the pressure loss generated when a high-pressure working fluid flows.

DESCRIPTION OF EMBODIMENTS

Hereinafter, embodiments according to the invention will be described with reference to the drawings, but the invention is not limited thereto. The components of the embodiments to be described below can be appropriately combined with one another. Further, there is a case where a part of the components are not used.

First Embodiment

[Construction Machine]

Figure 1:
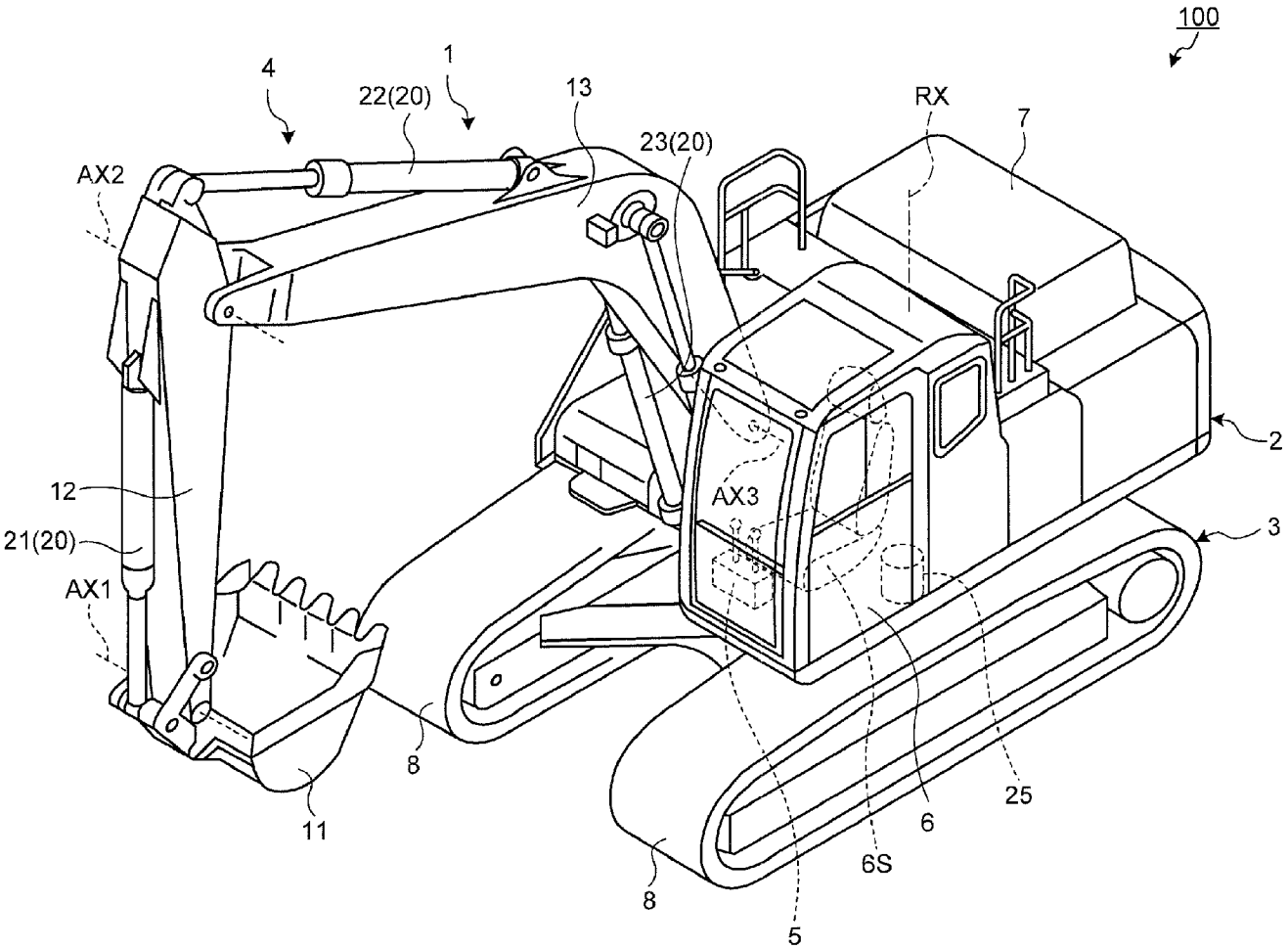
FIG. 1 is a perspective view illustrating an example of a construction machine according to a first embodiment.

A first embodiment will be described. FIG. 1 is a perspective view illustrating an example of a construction machine 100 according to the embodiment. In the embodiment, an example will be described in which the construction machine 100 is a hybrid type excavator. In the description below, the construction machine 100 will be appropriately referred to as the excavator 100.

As illustrated in FIG. 1, the excavator 100 includes a working implement 1 which is operated by a hydraulic pressure, an upper swinging body 2 which supports the working implement 1, a lower traveling body 3 which supports the upper swinging body 2, a drive device 4 which drives the excavator 100, and an operation device 5 which is used to operate the working implement 1.

The upper swinging body 2 includes a cab 6 in which an operator sits and a machine room 7. A driver seat 6S on which an operator sits is provided in the cab 6. The machine room 7 is disposed in rear of the cab 6. At least a part of the drive device 4 including an engine and a hydraulic pump is disposed in the machine room 7.

The lower traveling body 3 includes a pair of crawlers 8. By the rotation of the crawler 8, the excavator 100 travels. In addition, the lower traveling body 3 may be a vehicle wheel (a tire).

The working implement 1 is supported by the upper swinging body 2. The working implement 1 includes a bucket 11, an arm 12 connected to the bucket 11, and a boom 13 connected to the arm 12.

The bucket 11 and the arm 12 are connected to each other through a bucket pin. The bucket 11 is supported by the arm 12 so as to be rotatable about the rotation axis AX1. The arm 12 and the boom 13 are connected to each other through an arm pin. The arm 12 is supported by the boom 13 so as to be rotatable about the rotation axis AX2. The boom 13 and the upper swinging body 2 are connected to each other through a boom pin. The boom 13 is supported by a vehicle body 2 so as to be rotatable about the rotation axis AX3.

The rotation axis AX1, the rotation axis AX2, and the rotation axis AX3 are parallel to one another. The rotation axes AX1, AX2, and AX3 are orthogonal to the axis parallel to the swing axis RX. In the description below, the axial direction of each of the rotation axes AX1, AX2, and AX3 will be appropriately referred to as the vehicle width direction of the upper swinging body 2, and a direction orthogonal to the rotation axes AX1, AX2, and AX3 and the swing axis RX will be appropriately referred to as the front and rear direction of the upper swinging body 2. A direction in which the working implement 1 exists based on the swing axis RX will be set as the front direction. A direction in which the machine room 7 exists based on the swing axis RX will be set as the rear direction.

The drive device 4 includes a hydraulic cylinder 20 which operates the working implement 1 and an electric swinging motor 25 which generates power for swinging the upper swinging body 2. The hydraulic cylinder 20 is driven by working fluid. The hydraulic cylinder 20 includes a bucket cylinder 21 which operates the bucket 11, an arm cylinder 22 which operates the arm 12, and a boom cylinder 23 which operates the boom 13. The upper swinging body 2 is able to swing about the swing axis RX by the power generated by the electric swinging motor 25 while being supported by the lower traveling body 3.

The operation device 5 is disposed in the cab 6. The operation device 5 includes an operation member that is operated by the operator of the excavator 100. The operation member includes an operation lever or a joystick. By the operation of the operation device 5, the working implement 1 is operated.

[Control System]

Figure 2:
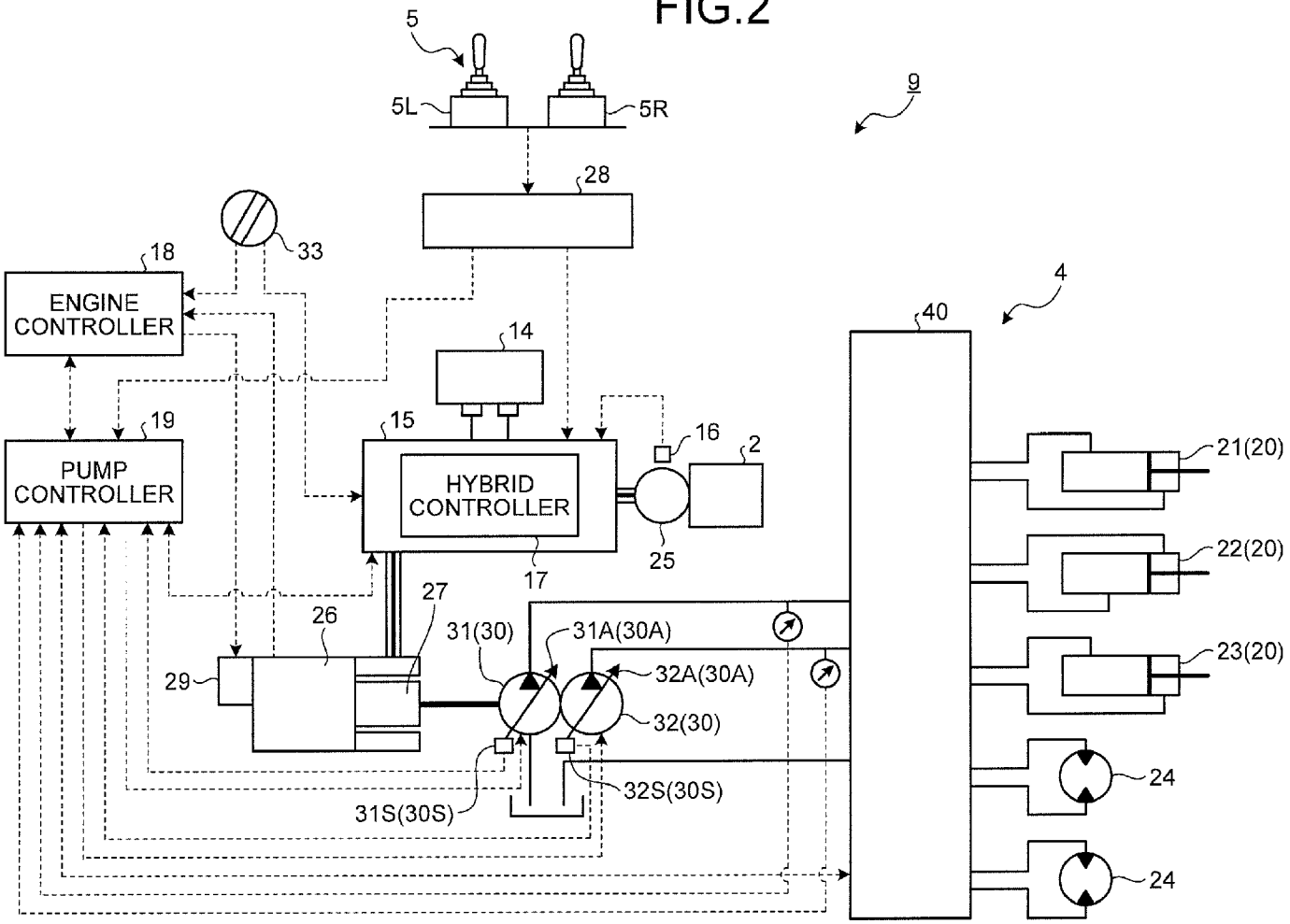
FIG. 2 is a diagram schematically illustrating a control system of the construction machine according to the first embodiment.

FIG. 2 is a diagram schematically illustrating a control system 9 including the drive device 4 of the excavator 100 according to the embodiment.

The drive device 4 includes an engine 26 as a drive source, a generator 27, and a hydraulic pump 30 which discharges working fluid. The engine 26 is, for example, a diesel engine. The generator 27 is, for example, a switched reluctance motor. In addition, the generator 27 may be a PM motor. The hydraulic pump 30 is a variable displacement hydraulic pump. In the embodiment, a swash plate type hydraulic pump is used as the hydraulic pump 30. The hydraulic pump 30 includes a first hydraulic pump 31 and a second hydraulic pump 32. The output shaft of the engine 26 is mechanically coupled to the generator 27 and the hydraulic pump 30. When the engine 26 is driven, the generator 27 and the hydraulic pump 30 are operated. In addition, the generator 27 may be mechanically and directly connected to the output shaft of the engine 26 and may be connected to the output shaft of the engine 26 through a power transmission mechanism such as PTO (power take off).

The drive device 4 includes a hydraulic drive system and an electric drive system.

The hydraulic drive system includes the hydraulic pump 30, a hydraulic circuit 40 through which working fluid discharged from the hydraulic pump 30 flows, a hydraulic cylinder 20 which is operated by working fluid supplied through the hydraulic circuit 40, and a traveling motor 24.

The electric drive system includes the generator 27, a storage battery 14 such as a capacitor, an inverter 15, and the electric swinging motor 25. When the engine 26 is driven, a rotor shaft of the generator 27 rotates. Accordingly, the generator 27 is able to generate power. The storage battery 14 is, for example, a double electric layer capacitor. The electrical power generated by the generator 27 or the electrical power discharged from the storage battery 14 is supplied to the electric swinging motor 25 through a power cable. The electric swinging motor 25 is operated based on the electrical power supplied from the generator 27 or the storage battery 14, and generates power for swinging the upper swinging body 2. The electric swinging motor 25 is, for example, a magnet embedded synchronous electric swinging motor. The electric swinging motor 25 is provided with a rotation sensor 26. The rotation sensor 26 is, for example, a resolver or a rotary encoder. The rotation sensor 26 detects the rotation speed of the electric swinging motor 25.

In the embodiment, the electric swinging motor 25 is able to generate regenerative energy in a deceleration state. The storage battery 14 is charged by the regenerative energy (the electric energy) generated by the electric swinging motor 25. In addition, the storage battery 14 may be a nickel hydrogen battery or a lithium ion battery instead of the double electric layer storage battery.

The drive device 4 is driven based on the operation of the operation device 5 provided in the cab 6. The operation amount of the operation device 5 is detected by an operation amount detecting unit 28. The operation amount detecting unit 28 includes a pressure sensor. A pilot pressure which is generated in response to the operation amount of the operation device 5 is detected by the operation amount detecting unit 28. The operation amount detecting unit 28 converts a detection signal of the pressure sensor into the operation amount of the operation device 5. In addition, the operation amount detecting unit 28 may include an electric sensor such as a potentiometer. When the operation device 5 includes an electric lever, an electric signal generated in response to the operation amount of the operation device 5 is detected by the operation amount detecting unit 28.

Further, the cab 6 is provided with a throttle dial 33. The throttle dial 33 is an operation unit for setting a fuel supply amount with respect to the engine 26.

The control system 9 includes a hybrid controller 17 which is provided in the inverter 15, an engine controller 18 which controls the engine 26, and a pump controller 19 which controls the hydraulic pump 30. Each of the hybrid controller 17, the engine controller 18, and the pump controller 19 includes a computer system. Each of the hybrid controller 17, the engine controller 18, and the pump controller 19 includes a processor such as a CPU (central processing unit), a storage device such as ROM (read only memory) or RAM (random access memory), and an input-output interface device. In addition, the hybrid controller 17, the engine controller 18, and the pump controller 19 may be integrated into one controller.

The hybrid controller 17 adjusts the temperature of the generator 27, the electric swinging motor 25, the storage battery 14, and the inverter 15 based on the detection signals of temperature sensors provided in the generator 27, the electric swinging motor 25, the storage battery 14, and the inverter 15. Further, the hybrid controller 17 performs charge/discharge control for the storage battery 14, generation control for the generator 27, and assist control for the engine 26 by the generator 27. Further, the hybrid controller 17 controls the electric swinging motor 25 based on the detection signal of a rotation sensor 16.

The engine controller 18 generates an instruction signal based on the setting value of the throttle dial 33, and outputs the instruction signal to a common rail control unit 29 provided in the engine 26. The common rail control unit 29 adjusts a fuel injection amount with respect to the engine 26 based on the instruction signal transmitted from the engine controller 18.

The pump controller 19 generates an instruction signal for adjusting the flow rate of the working fluid discharged from the hydraulic pump 30 based on the instruction signal transmitted from at least one of the engine controller 18 and the operation amount detecting unit 28. The pump controller 19 controls a swash plate angle as the inclination angle of a swash plate 30A of the hydraulic pump 30 so that the working fluid supply amount from the hydraulic pump 30 is adjusted. The hydraulic pump 30 is provided with a swash plate angle sensor 30S which detects the swash plate angle of the hydraulic pump 30. The swash plate angle sensor 30S includes a swash plate angle sensor 31S which detects the inclination angle of a swash plate 31A of the first hydraulic pump 31 and a swash plate angle sensor 32S which detects the inclination angle of a swash plate 32A of the second hydraulic pump 32. The detection signal of the swash plate angle sensor 30S is output to the pump controller 19. The pump controller 19 calculates the pump capacity (cc/rev) of the hydraulic pump 30 based on the detection signal of the swash plate angle sensor 30S. The hydraulic pump 30 is provided with a servo mechanism for driving the swash plate 30A. The pump controller 19 controls the servo mechanism so as to adjust the swash plate angle. The hydraulic circuit 40 is provided with a pump pressure sensor for detecting the pump discharge pressure of the hydraulic pump 30. The detection signal of the pump pressure sensor is output to the pump controller 19. In addition, the engine controller 18 and the pump controller 19 are connected to each other via an in-vehicle LAN (local area network) such as a CAN (controller area network). By the in-vehicle LAN, data may be transmitted between the engine controller 18 and the pump controller 19.

[Drive Device]

Figure 3:
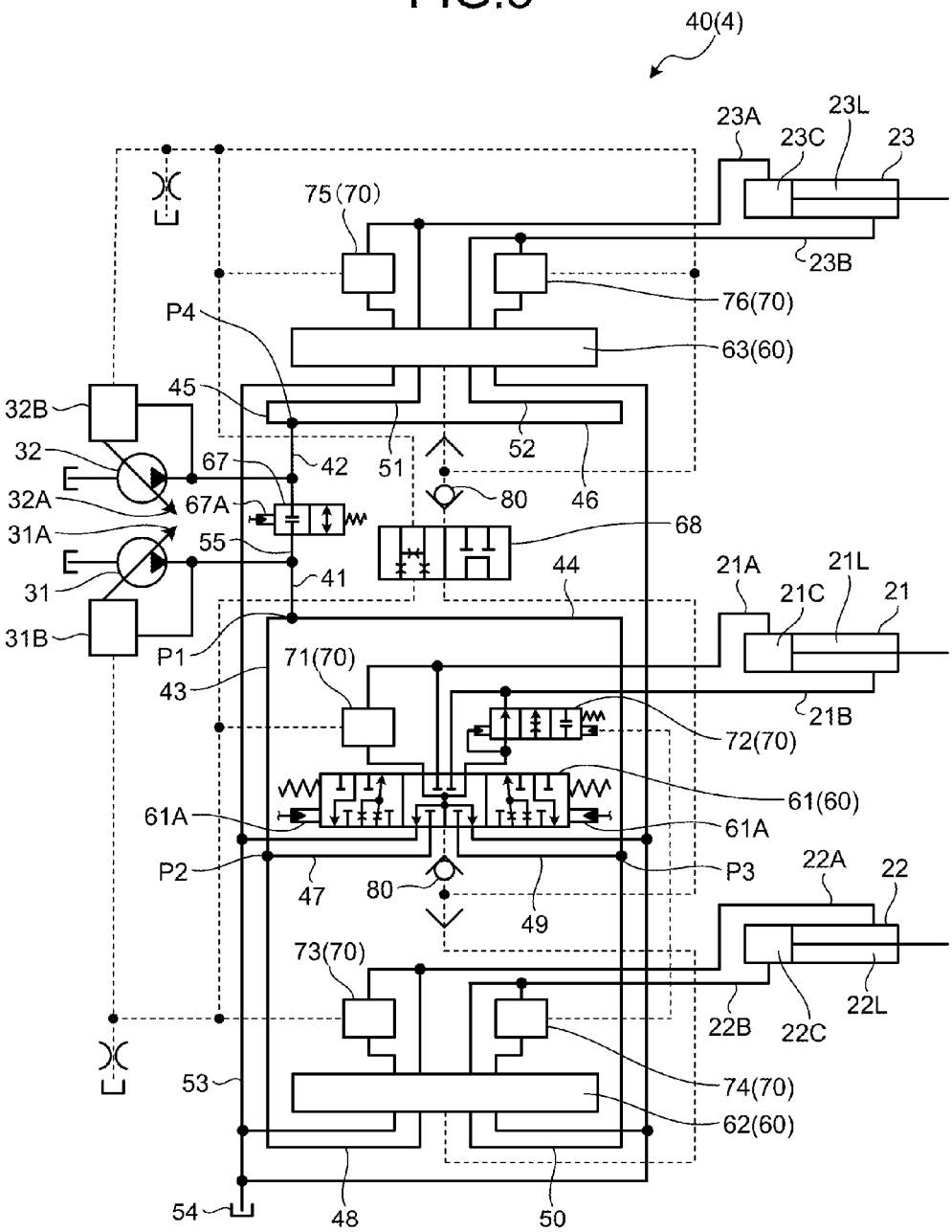
FIG. 3 is a diagram illustrating a hydraulic circuit of a drive device according to the first embodiment.

FIG. 3 is a diagram illustrating the hydraulic circuit 40 of the drive device 4 according to the embodiment. The drive device 4 includes the bucket cylinder 21, the arm cylinder 22, the boom cylinder 23, the first hydraulic pump 31 which discharges working fluid to be supplied to the bucket cylinder 21 and the arm cylinder 22, the second hydraulic pump 32 which discharges the working fluid to be supplied to the boom cylinder 23, and the hydraulic circuit 40 through which the working fluid discharged from the first hydraulic pump 31 and the second hydraulic pump 32 flows.

The hydraulic circuit 40 includes a first pump passage 41 connected to the first hydraulic pump 31 and a second pump passage 42 connected to the second hydraulic pump 32.

Further, the hydraulic circuit 40 includes first and second supply passages 43 and 44 connected to the first pump passage 41 and third and fourth supply passages 45 and 46 connected to the second pump passage 42.

The first pump passage 41 is branched into the first supply passage 43 and the second supply passage 44 at a first branch part P1. The second pump passage 42 is branched into the third supply passage 45 and the fourth supply passage 46 at a fourth branch part P4.

Further, the hydraulic circuit 40 includes first and second branch passages 47 and 48 which are connected to the first supply passage 43 and third and fourth branch passages 49 and 50 connected to the second supply passage 44. The first supply passage 43 is branched into the first branch passage 47 and the second branch passage 48 at a second branch part P2. The second supply passage 44 is branched into the third branch passage 49 and the fourth branch passage 50 at a third branch part P3.

Further, a passage circuit 40 includes a fifth branch passage 51 which is connected to the third supply passage 45 and a sixth branch passage 52 which is connected to the fourth supply passage 46.

Further, the hydraulic circuit 40 includes a first main operation valve 61 which is connected to the first branch passage 47 and the third branch passage 49, a second main operation valve 62 which is connected to the second branch passage 48 and the fourth branch passage 50, and a third main operation valve 63 which is connected to the fifth branch passage 51 and the sixth branch passage 52.

Further, the hydraulic circuit 40 includes a first bucket passage 21A which connects the first main operation valve 61 to a cap-side space 21C of the bucket cylinder 21 and a second bucket passage 21B which connects the first main operation valve 61 to a rod-side space 21L of the bucket cylinder 21.

Further, the hydraulic circuit 40 includes a first arm passage 22A which connects the second main operation valve 62 to a rod-side space 22L of the arm cylinder 22 and a second arm passage 22B which connects the second main operation valve 62 to a cap-side space 22C of the arm cylinder 22.

Further, the hydraulic circuit 40 includes a first boom passage 23A which connects the third main operation valve 63 to a cap-side space 23C of the boom cylinder 23 and a second boom passage 23B which connects the third main operation valve 63 to a rod-side space 23L of the boom cylinder 23.

The cap-side space of the hydraulic cylinder 20 is a space formed between a cylinder head cover and a piston. The rod-side space of the hydraulic cylinder 20 is a space in which a piston rod is disposed.

When the working fluid is supplied to the cap-side space 21C of the bucket cylinder 21 so that the bucket cylinder 21 is lengthened, the bucket 11 performs an excavating operation. When the working fluid is supplied to the rod-side space 21L of the bucket cylinder 21 so that the bucket cylinder 21 is shortened, the bucket 11 performs a dumping operation.

When the working fluid is supplied to the cap-side space 22C of the arm cylinder 22 so that the arm cylinder 22 is lengthened, the arm 12 performs an excavating operation. When the working fluid is supplied to the rod-side space 22L of the arm cylinder 22 so that the arm cylinder 22 is shortened, the arm 12 performs a dumping operation.

When the working fluid is supplied to the cap-side space 23C of the boom cylinder 23 so that the boom cylinder 23 is lengthened, the boom 13 is raised. When the working fluid is supplied to the rod-side space 23L of the boom cylinder 23 so that the boom cylinder 23 is shortened, the boom 13 is lowered.

The working implement 1 is operated by the operation of the operation device 5. In the embodiment, the operation device 5 includes a right operation lever 5R which is disposed at the right side of the operator sitting on the driver seat 6S and a left operation lever 5L which is disposed at the left side thereof. When the right operation lever is operated in the front and rear direction, the boom 13 is lowered and raised. When the right operation lever is operated in the left and right direction (the vehicle width direction), the bucket 11 performs the excavating operation and the dumping operation. When the left operation lever is operated in the front and rear direction, the arm 12 performs the dumping operation and the excavating operation. When the left operation lever is operated in the left and right direction, the upper swinging body 2 swings left and right. Further, the upper swinging body 2 may swing right and left when the left operation lever is operated in the front and rear direction and the arm 12 may perform the dumping operation and the excavating operation when the left operation lever is operated in the left and right direction.

The first hydraulic pump 31 and the second hydraulic pump 32 are driven by the engine 26. The swash plate 31A of the first hydraulic pump 31 is driven by a servo mechanism 31B. The servo mechanism 31B is operated based on the instruction signal from the pump controller 19, and adjusts the inclination angle of the swash plate 31A of the first hydraulic pump 31. When the inclination angle of the swash plate 31A of the first hydraulic pump 31 is adjusted, the pump capacity (cc/rev) of the first hydraulic pump 31 is adjusted. Similarly, the swash plate 32A of the second hydraulic pump 32 is driven by a servo mechanism 32B. When the inclination angle of the swash plate 32A of the second hydraulic pump 32 is adjusted, the pump capacity (cc/rev) of the second hydraulic pump 32 is adjusted.

The first main operation valve 61 is a direction control valve which adjusts the direction and the flow rate of the working fluid supplied from the first hydraulic pump 31 to the bucket cylinder 21. The second main operation valve 62 is a direction control valve which adjusts the direction and the flow rate of the working fluid supplied from the first hydraulic pump 31 to the arm cylinder 22. The third main operation valve 63 is a direction control valve which adjusts the direction and the flow rate of the working fluid supplied from the second hydraulic pump 32 to the boom cylinder 23.

The first main operation valve 61 is a slide spool type direction control valve.

The spool of the first main operation valve 61 is movable among a stop position in which the supply of the working fluid to the bucket cylinder 21 is stopped so as to stop the bucket cylinder 21, a first position in which the first branch passage 47 is connected to the first bucket passage 21A so as to supply the working fluid to the cap-side space 21C so that the bucket cylinder 21 is lengthened, and a second position in which the third branch passage 49 is connected to the second bucket passage 21B so as to supply the working fluid to the rod-side space 21L so that the bucket cylinder 21 is shortened. The first main operation valve 61 is operated so that at least one of the stop state, the lengthened state, and the shortened state of the bucket cylinder 21 is realized.

The second main operation valve 62 has the same structure as the first main operation valve 61. The spool of the second main operation valve 62 is movable among a stop position in which the supply of the working fluid to the arm cylinder 22 is stopped so as to stop the arm cylinder 22, a second position in which the fourth branch passage 50 is connected to the second arm passage 22B so as to supply the working fluid to the cap-side space 22C so that the arm cylinder 22 is lengthened, and a first position in which the second branch passage 48 is connected to the first arm passage 22A so as to supply the working fluid to the rod-side space 22L so that the arm cylinder 22 is shortened. The second main operation valve 62 is operated so that at least one of the stop state, the lengthened state, and the shortened state of the arm cylinder 22 is realized.

The third main operation valve 63 has the same structure as the first main operation valve 61. The spool of the third main operation valve 63 is movable among a stop position in which the supply of the working fluid to the boom cylinder 23 is stopped so as to stop the boom cylinder 23, a first position in which the fifth branch passage 51 is connected to the first boom passage 23A so as to supply the working fluid to the cap-side space 23C so that the boom cylinder 23 is lengthened, and a second position in which the sixth branch passage 52 is connected to the second boom passage 23B so as to supply the working fluid to the rod-side space 23L so that the boom cylinder 23 is shortened. The third main operation valve 63 is operated so that at least one of the stop state, the lengthened state, and the shortened state of the boom cylinder 23 is realized.

The first main operation valve 61 is operated by the operation device 5. When the operation device 5 is operated, the direction and the flow rate of the working fluid supplied from the first main operation valve 61 to the bucket cylinder 21 are determined. The bucket cylinder 21 is operated in the movement direction corresponding to the direction of the working fluid supplied to the bucket cylinder 21 and the bucket cylinder 21 is operated at the cylinder speed corresponding to the flow rate of the working fluid supplied to the bucket cylinder 21.

Similarly, the second main operation valve 62 is operated by the operation device 5. When the operation device 5 is operated, the direction and the flow rate of the working fluid supplied from the second main operation valve 62 to the arm cylinder 22 are determined. The arm cylinder 22 is operated in the movement direction corresponding to the direction of the working fluid supplied to the arm cylinder 22, and the arm cylinder 22 is operated at the cylinder speed corresponding to the flow rate of the working fluid supplied to the arm cylinder 22.

Similarly, the third main operation valve 63 is operated by the operation device 5. When the operation device 5 is operated, the direction and the flow rate of the working fluid supplied from the third main operation valve 63 to the boom cylinder 23 are determined. The boom cylinder 23 is operated in the movement direction corresponding to the direction of the working fluid supplied to the boom cylinder 23, and the boom cylinder 23 is operated at the cylinder speed corresponding to the flow rate of the working fluid supplied to the boom cylinder 23.

When the bucket cylinder 21 is operated, the bucket 11 is driven based on the movement direction and the cylinder speed of the bucket cylinder 21. When the arm cylinder 22 is operated, the arm 12 is driven based on the movement direction and the cylinder speed of the arm cylinder 22. When the boom cylinder 23 is operated, the boom 13 is driven based on the movement direction and the cylinder speed of the boom cylinder 23.

The working fluid discharged from the bucket cylinder 21, the arm cylinder 22, and the boom cylinder 23 are discharged to a tank 54 through a discharge passage 53.

The first pump passage 41 and the second pump passage 42 are connected to each other by a junction passage 55. The junction passage 55 is provided with a first dividing/merging valve 67. The first dividing/merging valve 67 is a switching valve which switches a merged state in which the first pump passage 41 is connected to the second pump passage 42 and a divided state in which the first pump passage 41 is separated from the second pump passage 42. The merged state indicates a state where the first pump passage 41 is connected to the second pump passage 42 through the junction passage 55 and the working fluid discharged from the first pump passage 41 is merged with the working fluid discharged from the second pump passage 42 at the dividing/merging valve. The divided state indicates a state where the junction passage 55 connecting the first pump passage 41 to the second pump passage 42 is separated by the dividing/merging valve and the working fluid discharged from the first pump passage 41 is separated from the working fluid discharged from the second pump passage 42.

The spool of the first dividing/merging valve 67 is movable between a merging position in which the junction passage 55 is opened so as to connect the first pump passage 41 to the second pump passage 42 and a dividing position in which the junction passage 55 is closed so as to separate the first pump passage 41 from the second pump passage 42. The first dividing/merging valve 67 is controlled so that the first pump passage 41 and the second pump passage 42 are merged or divided.

The hydraulic circuit 40 includes a second dividing/merging valve 68. A shuttle valve 80 which is provided between the first main operation valve 61 and the second main operation valve 62 is connected to the second dividing/merging valve 68. The maximum pressure of the first main operation valve 61 and the second main operation valve 62 is selected by the shuttle valve 80, and is output to the second merging valve 68. Further, the shuttle valve 80 is connected between the second dividing/merging valve 68 and the third main operation valve 63. The second dividing/merging valve 68 selects the maximum pressure of the load sensing pressure (the LS pressure) obtained by depressurizing the working fluid supplied to each shaft of the bucket cylinder 21 (the first shaft), the arm cylinder (the second shaft), and the boom cylinder 23 (the third shaft) by the shuttle valve 80. The load sensing pressure is a pilot pressure used to compensate a pressure. When the second dividing/merging valve 68 is in the merged state, the maximum LS pressure of the first shaft to the third shaft is selected and is supplied to the pressure compensating valve 70 of each of the first shaft to the third shaft, the servo mechanism 31B of the first hydraulic pump 31, and the servo mechanism 32B of the second hydraulic pump 32. Meanwhile, when the second dividing/merging valve 68 is in the divided state, the maximum LS pressure of the first shaft and the second shaft is supplied to the pressure compensating valves 70 of the first shaft and the second shaft and the servo mechanism 31B of the first hydraulic pump 31, and the LS pressure of the third shaft is supplied to the pressure compensating valve 70 of the third shaft and the servo mechanism 32B of the second hydraulic pump 32.

The shuttle valve 80 selects the pilot pressure indicating the maximum value among the pilot pressure values output from the first main operation valve 61, the second main operation valve 62, and the third main operation valve 63 in the merged state. The selected pilot pressure is supplied to the pressure compensating valve 70 and the servo mechanism (31B, 32B) of the hydraulic pump 30 (31, 32).

[Pressure Compensating Valve]

The hydraulic circuit 40 includes the pressure compensating valve 70. The pressure compensating valve 70 includes a port used to select any one of a communication state, a narrowed state, and an interruption state, and includes a throttle valve enabling any one of the interruption state, the narrowed state, and the communication state by the own pressure. The pressure compensating valve 70 is used to compensate the flow rate distributed in response to the ratio of the metering opening area of each shaft even when the load pressure values of the shafts are different. When the pressure compensating valve 70 is not provided, most of the working fluid flows toward the low-pressure-side shaft. Since the pressure compensating valve 70 causes the pressure loss to occur in the low-pressure-side shaft so that the outlet pressure of a main operation valve 60 of the low-pressure-side shaft becomes equal to the outlet pressure of the main operation valve 60 of the maximum-load-pressure-side shaft, the outlet pressure values of the main operation valves 60 are equal to one another, and hence the flow rate distributing function is realized.

The pressure compensating valve 70 includes a pressure compensating valve 71 and a pressure compensating valve 72 connected to the first main operation valve 61, includes a pressure compensating valve 73 and a pressure compensating valve 74 connected to the second main operation valve 62, and also includes a pressure compensating valve 75 and a pressure compensating valve 76 connected to the third main operation valve 63.

The pressure compensating valve 71 compensates the pre/post-differential pressure (the metering differential pressure) of the first main operation valve 61 while the first branch passage 47 is connected to the first bucket passage 21A so that the working fluid is supplied to the cap-side space 21C. The pressure compensating valve 72 compensates the pre/post-differential pressure (the metering differential pressure) of the first main operation valve 61 while the third branch passage 49 is connected to the second bucket passage 21B so that the working fluid is supplied to the rod-side space 21L.

The pressure compensating valve 73 compensates the pre/post-differential pressure (the metering differential pressure) of the second main operation valve 62 while the second branch passage 48 is connected to the first arm passage 22A so that the working fluid is supplied to the rod-side space 22L. The pressure compensating valve 74 compensates the pre/post-differential pressure (the metering differential pressure) of the second main operation valve 62 while the fourth branch passage 50 is connected to the second arm passage 22B so that the working fluid is supplied to the cap-side space 22C.

In addition, the pre/post-differential pressure (the metering differential pressure) of the main operation valve indicates a difference between the pressure of the inlet port corresponding to the hydraulic pump of the main operation valve and the pressure of the outlet port corresponding to the hydraulic cylinder, and corresponds to a differential pressure for measuring (metering) the flow rate.

Even when a small load acts on one hydraulic cylinder 20 of the bucket cylinder 21 and the arm cylinder 22 and a large load acts on the other hydraulic cylinder 20 by the pressure compensating valve 70, the working fluid can be distributed to each of the bucket cylinder 21 and the arm cylinder 22 at the flow rate in response to the operation amount of the operation device 5.

The pressure compensating valve 70 is able to supply the working fluid at the flow rate based on the operation regardless of the load values of the hydraulic cylinders 20. For example, when a large load acts on the bucket cylinder 21 and a small load acts on the arm cylinder 22, the pressure compensating valve 70 (73, 74) disposed at the small load side compensates the differential pressure so that the metering differential pressure $\Delta P2$ at the small load side substantially becomes equal to the differential pressure $\Delta P1$ and the working fluid is supplied at the flow rate based on the operation amount of the second main operation valve 62 when the working fluid is supplied from the second main operation valve 62 to the arm cylinder 22 regardless of the metering differential pressure $\Delta P1$ generated by the supply of the working fluid from the first main operation valve 61 to the bucket cylinder 21. Meanwhile, when a large load acts on the arm cylinder 22 and a small load acts on the bucket cylinder 21, the pressure compensating valve 70 (71, 72) at the small load side compensates the metering differential pressure $\Delta P1$ at the small load side so that the working fluid is supplied at the flow rate based on the operation amount of the first main operation valve 61 when the working fluid is supplied from the first main operation valve 61 to the bucket cylinder 21 regardless of the metering differential pressure $\Delta P2$ generated by the supply of the working fluid from the second main operation valve 62 to the arm cylinder 22.

Figure 4:
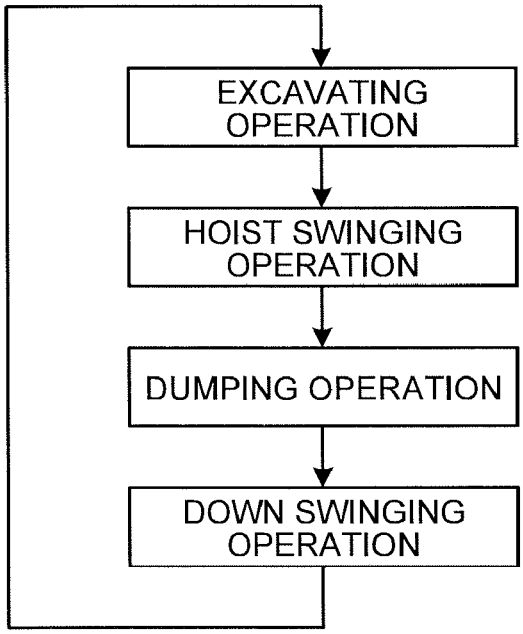
FIG. 4 is a diagram illustrating an example of the operation of the construction machine according to the first embodiment.

FIG. 4 is a flowchart illustrating an example of the operation of the excavator 100. As illustrated in FIG. 4, generally, the excavator 100 repeats a series of operations, that is, an excavating operation, a hoist swinging operation, a dumping operation, and a down swinging operation. The excavating operation indicates an operation in which an excavating target is excavated by the excavating operation using the bucket 11 and the arm 12. The hoist swinging operation indicates an operation in which the upper swinging body 2 swings to face an excavation material discharge position (for example, a cargo bed of a dump truck) while the boom 13 is raised and an excavation material is held inside the bucket 11 after the excavating operation. The dumping operation indicates an operation in which the excavation material of the bucket 11 is discharged by the dumping operation using the bucket 11 and the arm 12. The down swinging operation indicates an operation in which the upper swinging body 2 swings to face the excavating target while the boom 13 is lowered after the discharge operation. The excavating operation is performed after the down swinging operation.

Generally, in the excavating operation, the bucket cylinder 21 and the arm cylinder 22 are operated (lengthened) in the same direction so as to perform the excavating operation using both the bucket 11 and the arm 12. In the dumping operation, the bucket cylinder 21 and the arm cylinder 22 are operated (shortened) in the same direction so as to perform the dumping operation using both the bucket 11 and the arm 12. In the excavating operation and the dumping operation, a load higher than the boom cylinder 23 acts on the bucket cylinder 21 and the arm cylinder 22. For that reason, the bucket cylinder 21 and the arm cylinder 22 require the high-pressure working fluid. Meanwhile, the boom cylinder 23 requires a large flow rate of the working fluid, but is driven by the low-pressure working fluid compared with the bucket cylinder 21 and the arm cylinder 22.

Figure 5:
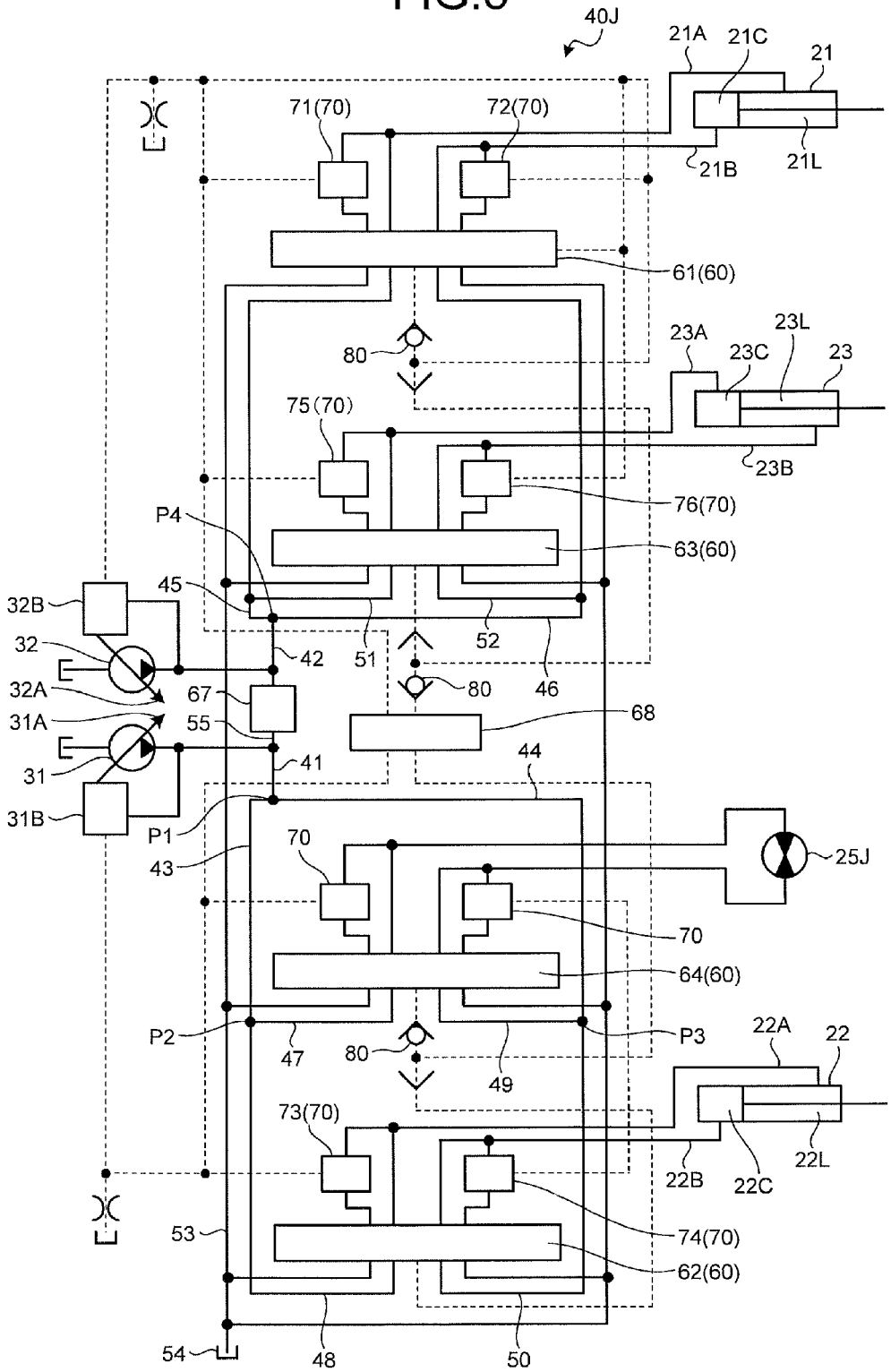
FIG. 5 is a diagram illustrating a hydraulic circuit of a drive device according to a comparative example.
Figure 6:
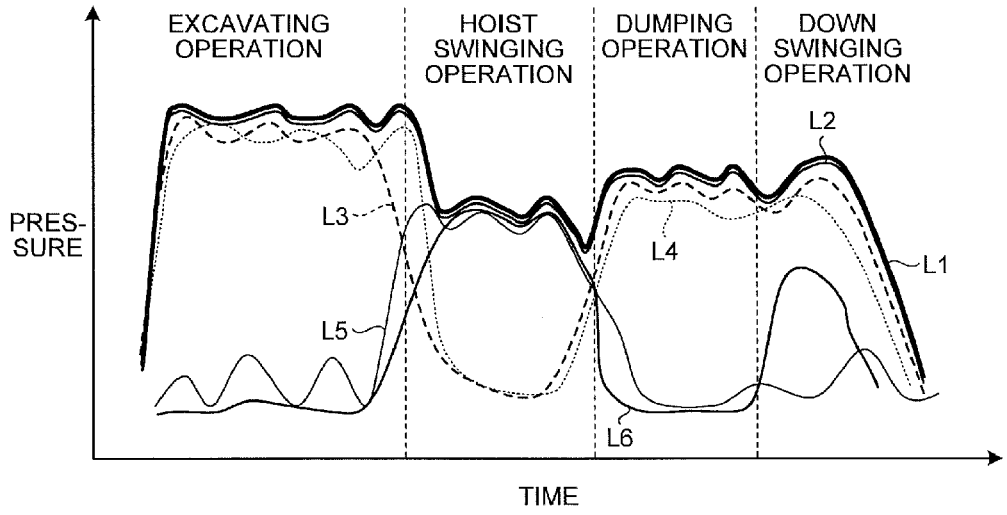
FIG. 6 is a diagram illustrating a change in pressure of working fluid of a construction machine according to the comparative example.

FIG. 5 is a diagram illustrating a hydraulic circuit 40J of a drive device according to a comparative example. FIG. 6 is a diagram illustrating a change in pressure of the working fluid according to the comparative example. As illustrated in FIG. 5, in the hydraulic circuit 40J of the excavator according to the comparative example, the working fluid is supplied from the first hydraulic pump 31 to the arm cylinder 22 and a hydraulic swinging motor 25J and the working fluid is supplied from the second hydraulic pump 32 to the boom cylinder 23 and the bucket cylinder 21 in the divided state of the first hydraulic pump 31 and the second hydraulic pump 32. That is, in the excavator according to the comparative example, the working fluid is supplied from the same pump to the boom cylinder and the bucket cylinder. The hydraulic swinging motor 25J is a hydraulic actuator for swinging the upper swinging body 2 and is operated by a hydraulic pressure.

In the hydraulic circuit 40J according to the comparative example, the first main operation valve 61 and the rod-side space 21L of the bucket cylinder 21 are connected through the first bucket passage 21A, and the first main operation valve 61 and the cap-side space 21C of the bucket cylinder 21 are connected through the second bucket passage 21B.

Further, in the hydraulic circuit 40J according to the comparative example, the second main operation valve 62 and the rod-side space 22L of the arm cylinder 22 are connected through the first arm passage 22B, and the second main operation valve 62 and the cap-side space 22C of the arm cylinder 22 are connected through the second arm passage 22A.

Further, in the hydraulic circuit 40J according to the comparative example, the third main operation valve 63 and the cap-side space 23C of the boom cylinder 23 are connected through the first boom passage 23A, and the third main operation valve 63 and the rod-side space 23L of the boom cylinder 23 are connected through the second boom passage 23B.

In FIG. 6, the horizontal axis indicates the elapse time from the excavating operation, and the vertical axis indicates the pressure of the working fluid. The line L1 indicates the pressure of the working fluid discharged from the first hydraulic pump. The line L2 indicates the pressure of the working fluid discharged from the second hydraulic pump. The line L3 indicates the pressure of the working fluid flowing into the arm cylinder. The line L4 indicates the pressure of the working fluid flowing into the bucket cylinder. The line L5 indicates the pressure of the working fluid flowing into the boom cylinder. The line L6 indicates the pressure of the working fluid flowing into the hydraulic swinging motor 25J.

As described above, since the arm cylinder 22 requires the high-pressure working fluid in the excavating operation and the dumping operation in the divided state, the pressure of the working fluid discharged from the first hydraulic pump 31 supplying the working fluid to the arm cylinder 22 is high in the excavating operation and the dumping operation as indicated by the line L1 of FIG. 6. Similarly, since the bucket cylinder 21 requires the high-pressure working fluid in the excavating operation and the dumping operation, the pressure of the working fluid discharged from the second hydraulic pump 32 supplying the working fluid to the bucket cylinder 21 is high in the excavating operation and the dumping operation as indicated by the line L2 of FIG. 6.

Further, in the excavating operation and the dumping operation, the pressure of the working fluid supplied to the arm cylinder 22 and the bucket cylinder 21 is high as indicated by the line L3 and the line L4 of FIG. 6. Further, the pressure of the working fluid supplied to the hydraulic swinging motor 25J is high the hoist swinging operation and the down swinging operation as indicated by the line L6 of FIG. 6.

Meanwhile, as described above, the boom cylinder 23 can be driven by the low-pressure working fluid without a large load acting on the boom cylinder 23. Then, as indicated by the line L5 of FIG. 6, the pressure of the working fluid supplied to the boom cylinder 23 is slightly high in the hoist swinging operation. However, the pressure of the working fluid is low in each of the excavating operation, the dumping operation, and the down swinging operation. That is, the high-pressure working fluid is discharged from the second hydraulic pump 32. However, since the pressure of the working fluid supplied to the boom cylinder 23 is low, the pressure loss of the working fluid occurs in the pressure compensating valve 70. Further, pressure loss occurs in the bucket cylinder 21 and the arm cylinder 22 during the hoist swinging operation.

Figure 7:
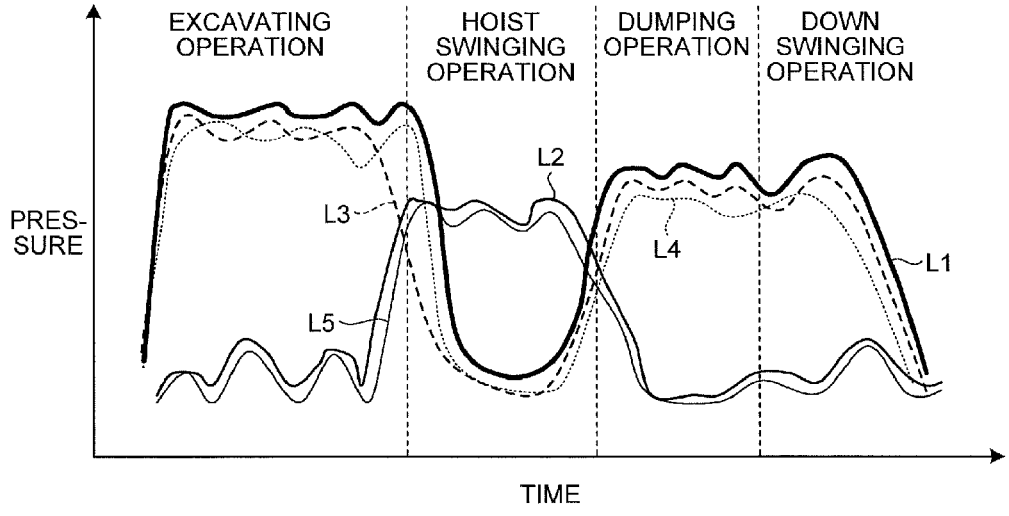
FIG. 7 is a diagram illustrating a change in pressure of working fluid of the construction machine according to the first embodiment.

FIG. 7 is a diagram illustrating a change in pressure of the working fluid according to the embodiment. In the excavator 100 according to the embodiment, the working fluid is supplied from the first hydraulic pump 31 to the bucket cylinder 11 and the arm cylinder 12 and the working fluid is supplied from the second hydraulic pump 32 to the boom cylinder 13. In FIG. 7, the horizontal axis indicates the elapse time from the start of the excavating operation, and the vertical axis indicates the pressure of the working fluid. The line L1 indicates the pressure of the working fluid discharged from the first hydraulic pump 31. The line L2 indicates the pressure of the working fluid discharged from the second hydraulic pump 32. The line L3 indicates the pressure of the working fluid (metering pressure) flowing into the arm cylinder 22. The line L4 indicates the pressure of the working fluid (metering pressure) flowing into the bucket cylinder 21. The line L5 indicates the pressure of the working fluid (metering pressure) flowing into the boom cylinder 23.

In the excavating operation and the dumping operation, since the bucket cylinder 21 and the arm cylinder 22 require the high-pressure working fluid, the pressure of the working fluid discharged from the first hydraulic pump 31 supplying the working fluid to the bucket cylinder 21 and the arm cylinder 22 is high in the excavating operation and the dumping operation as indicated by the line L1 of FIG. 7.

Further, in the excavating operation and the dumping operation, the pressure of the working fluid supplied to the arm cylinder 21 and the bucket cylinder 22 is high as indicated by the line L3 and the line L4 of FIG. 7.

The boom cylinder 23 can be driven by the low-pressure working fluid without a large load acting on the boom cylinder 23. Then, as indicated by the line L5 of FIG. 7, the pressure of the working fluid supplied to the boom cylinder 23 is slightly high in the hoist swinging operation. However, the pressure of the working fluid is low in each of the excavating operation, the dumping operation, and the down swinging operation. In the embodiment, the first hydraulic pump 31 supplying the working fluid to the bucket cylinder 21 and the arm cylinder 22 and the second hydraulic pump 32 supplying the working fluid to the boom cylinder 23 are different hydraulic pumps. The pressure of the working fluid discharged from the second hydraulic pump 32 is low in response to the pressure of the working fluid necessary for the boom cylinder 23. That is, as indicated by the line L2 and the line L5 of FIG. 7, a difference between the pressure of the working fluid discharged from the second hydraulic pump 32 and the pressure of the working fluid flowing from the boom cylinder 23 is small. That is, it is understood that the pressure loss is suppressed and the hydraulic energy loss is suppressed.

Further, in the embodiment, the working fluid passing through the first supply passage 43 is supplied to the cap-side space 21C of the bucket cylinder 21, and the working fluid passing through the second supply passage 44 is supplied to the cap-side space 22C of the arm cylinder 22. Further, the working fluid passing through the second supply passage 44 is supplied to the rod-side space 21L of the bucket cylinder 21, and the working fluid passing through the first supply passage 43 is supplied to the rod-side space 22L of the arm cylinder 22.

As described above, in the excavating operation, the bucket cylinder 21 and the arm cylinder 22 are operated (lengthened) in the same direction. That is, in the excavating operation, the working fluid is supplied to each of the cap-side space 21C of the bucket cylinder 21 and the cap-side space 22C of the arm cylinder 22. Since a high load acts on both the bucket cylinder 21 and the arm cylinder 22 in the excavating operation, the high-pressure working fluid needs to be supplied to each of the cap-side space 21C of the bucket cylinder 21 and the cap-side space 22C of the arm cylinder 22. As in the related art, when the high-pressure working fluid supplied to the cap-side space 21C of the bucket cylinder 21 and the high-pressure working fluid supplied to the cap-side space 22C of the arm cylinder 22 pass through the same passage (for example, the first supply passage 43), are branched at the branch part (for example, the second branch part P2), and are supplied to the cap-side space 21C of the bucket cylinder 21 and the cap-side space 22C of the arm cylinder 22, pressure loss occurs in the branch part of the passage while the high-pressure working fluid passes through the narrow passage. The pressure loss of the working fluid is extremely large, and hence hydraulic energy loss occurs.

Further, in the dumping operation, the bucket cylinder 21 and the arm cylinder 22 are operated (shortened) in the same direction. That is, the working fluid is supplied to each of the rod-side space 21L of the bucket cylinder 21 and the rod-side space 22L of the arm cylinder 22 in the shortening operation. Since a high load acts on both the bucket cylinder 21 and the arm cylinder 22 even in the dumping operation, the high-pressure working fluid needs to be supplied to each of the rod-side space 21L of the bucket cylinder 21 and the rod-side space 22L of the arm cylinder 22. When the high-pressure working fluid supplied to the rod-side space 21L of the bucket cylinder 21 and the high-pressure working fluid supplied to the rod-side space 22L of the arm cylinder 22 pass through the same passage (for example, the second supply passage 44), are branched in the branch part (for example, the third branch part P3), and are supplied to each of the rod-side space 21L of the bucket cylinder 21 and the rod-side space 22L of the arm cylinder 22, pressure loss occurs in the branch part of the passage while the high-pressure working fluid passes through the narrow passage. The pressure loss of the working fluid is extremely large, and hence hydraulic energy loss occurs.

In the embodiment, the working fluid discharged from the first hydraulic pump 31 is branched into the first supply passage 43 and the second supply passage 44, and is supplied to each of the cap-side space 21C of the bucket cylinder 21 and the cap-side space 22C of the arm cylinder 22. That is, in the excavating operation, the high-pressure working fluid discharged from the first hydraulic pump 31 does not flow through the same passage. In other words, the high-pressure working fluid is branched into the first supply passage 43 and the second supply passage 44 and is supplied to each of the cap-side space 21C of the bucket cylinder 21 and the cap-side space 22C of the arm cylinder 22. For that reason, an increase in pressure loss is suppressed.

Similarly, the working fluid discharged from the first hydraulic pump 31 is branched into the first supply passage 43 and the second supply passage 44, and is supplied to each of the rod-side space 22L of the arm cylinder 22 and the rod-side space 21L of the bucket cylinder 21. That is, in the dumping operation, the high-pressure working fluid discharged from the first hydraulic pump 31 does not flow through the same passage. In other words, the high-pressure working fluid is branched into the first supply passage 43 and the second supply passage 44 and is supplied to each of the rod-side space 22L of the arm cylinder 22 and the rod-side space 21L of the bucket cylinder 21. For that reason, an increase in pressure loss is suppressed.

In this way, in the drive device 4 according to the embodiment, an increase in pressure loss caused when the high-pressure working fluid flows is suppressed, and hence degradation in fuel efficiency caused by the pressure loss is suppressed.

[Operation and Effect]

As described above, according to the embodiment, in the divided state in which the working fluid discharged from the first hydraulic pump 31 and the working fluid discharged from the second hydraulic pump 32 are not merged in the first dividing/merging valve 67, the bucket cylinder 21 and the arm cylinder 22 having a high load pressure are driven by the working fluid discharged from one hydraulic pump 30 (the first hydraulic pump 31), and the boom cylinder 23 having a low load pressure is driven by the working fluid discharged from the different hydraulic pump (the second hydraulic pump 32).

That is, when the first hydraulic pump 31 and the second hydraulic pump 32 are in the divided state, there is no need to increase the operation pressure of the boom cylinder 23 having a low load pressure to the high pressure (the load pressure of the arm cylinder 22 or the bucket cylinder 21) by the pressure compensating valve 70, and hence an increase in pressure loss is suppressed. Further, since the working fluid supplied to the bucket cylinder 21 and the working fluid supplied to the arm cylinder 22 can be supplied from different passages in the excavating operation and the dumping operation, an increase in pressure loss inside the main operation valve 60 is suppressed.

Further, in the embodiment, the upper swinging body 2 swings by the power generated by the electric swinging motor 25, and the boom cylinder 23 is operated by the working fluid discharged from the second hydraulic pump 32. When the hydraulic swinging motor is used to swing the upper swinging body 2, the working fluid discharged from the first hydraulic pump 31 is supplied to the arm cylinder 22 and the hydraulic swinging motor, and the working fluid discharged from the second hydraulic pump 32 is distributed to the boom cylinder 23 and the bucket cylinder 21, pressure loss occurs in the boom cylinder 23 during the down swinging operation. When the upper swinging body 2 is swung by the electric swinging motor 25 and the bucket cylinder 21 and the arm cylinder 22 are driven by the working fluid discharged from the first hydraulic pump 31, the pressure loss in the boom cylinder 23 is suppressed. Further, when the pressure compensating valve is provided so as to improve the operability of the operation device 5, pressure loss is caused by the pressure compensating valve. In the embodiment, the boom cylinder 23 is operated by one hydraulic pump 30 (the second hydraulic pump 32) and the upper swinging body 2 is swung by the electric swinging motor 25. For that reason, degradation in operability and pressure loss are suppressed.

Second Embodiment

A second embodiment will be described. In the description below, the same reference numerals will be given to the identical or equivalent components to those of the above-described embodiment, and the description thereof will be briefly made or omitted.

Figure 8:
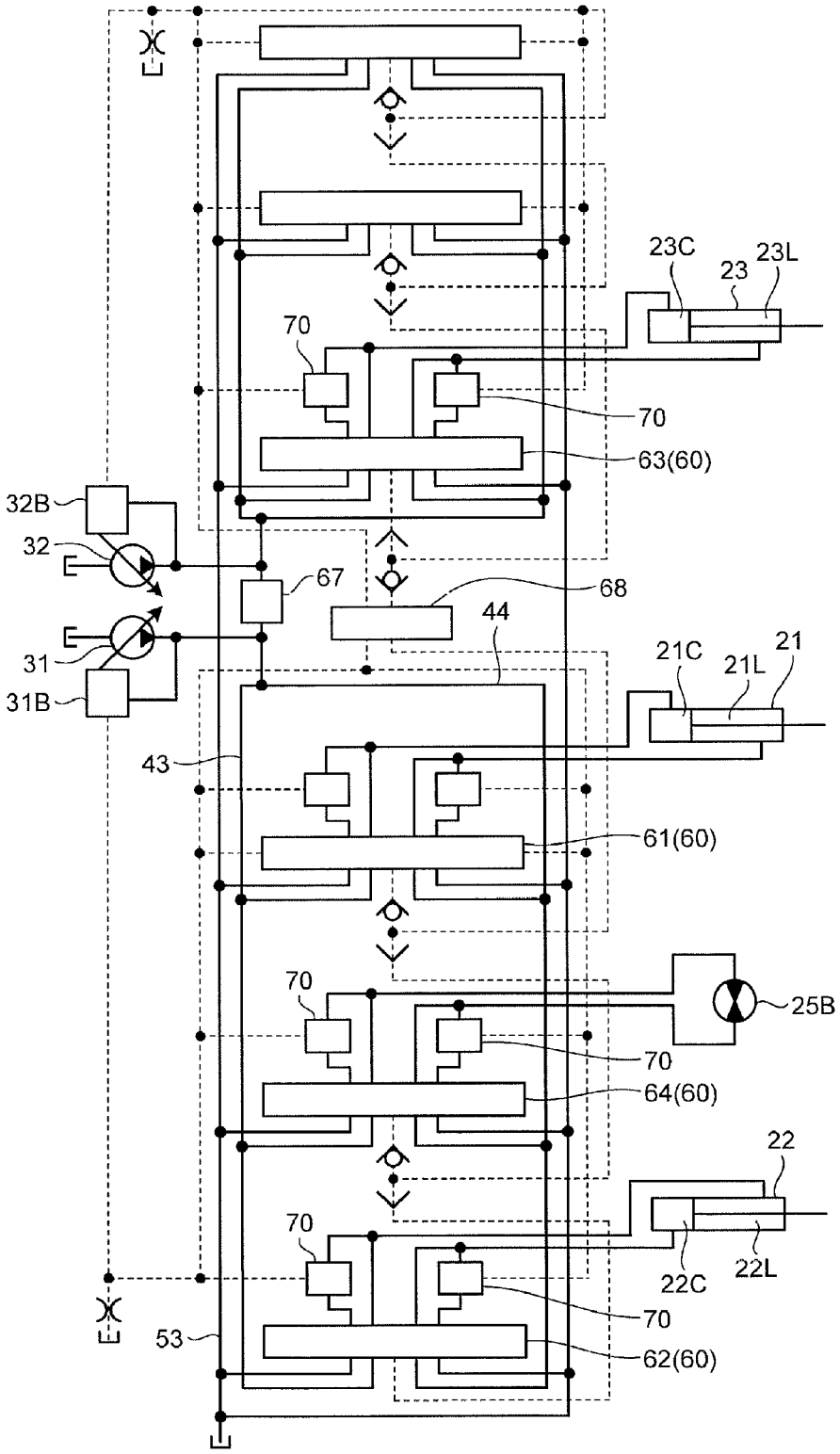
FIG. 8 is a diagram illustrating a hydraulic circuit of a drive device according to a second embodiment.

In the first embodiment, the upper swinging body 2 is swung by the electric swinging motor 25 operated by electrical power. As illustrated in FIG. 8, a hydraulic swinging motor 25B may be provided so as to swing the upper swinging body 2. The hydraulic swinging motor 25B is operated by a hydraulic pressure. The hydraulic swinging motor 25B is connected to a fourth main operation valve 64 as a service valve. Even in the embodiment, the working fluid discharged from the second hydraulic pump 32 is supplied only to the boom cylinder 23 when the first hydraulic pump 31 and the second hydraulic pump 32 are in the divided state. When the first hydraulic pump 31 and the second hydraulic pump 32 are in the divided state, the working fluid discharged from the first hydraulic pump 31 is supplied to the bucket cylinder 21, the arm cylinder 22, and the hydraulic swinging motor 25B. The working fluid passing through the first supply passage 43 is supplied to the cap-side space 21C of the bucket cylinder 21, and the working fluid passing through the second supply passage 44 is supplied to the cap-side space 22C of the arm cylinder 22. Further, the working fluid passing through the second supply passage 44 is supplied to the rod-side space 21L of the bucket cylinder 21, and the working fluid passing through the first supply passage 43 is supplied to the rod-side space 22L of the arm cylinder 22. Even in the embodiment, degradation in operability and hydraulic energy loss are suppressed.

In the embodiment, when the first hydraulic pump 31 and the second hydraulic pump 32 are in the divided state, the hydraulic swinging motor 25B is operated by the working fluid discharged from the first hydraulic pump 31, and the boom cylinder 23 is operated by the working fluid discharged from the second hydraulic pump 32. Since the hydraulic swinging motor 25B and the boom cylinder 23 are operated by the working fluids discharged from the different hydraulic pumps 30, it is possible to suppress degradation in operability of the operation device 5 and hydraulic energy loss in the down swinging operation.

In addition, in the above-described embodiments, the drive device 4 (the hydraulic circuit 40) is applied to the excavator 100. The application target of the drive device 4 is not limited to the excavator, and can be widely applied to a hydraulic driven construction machine other than the excavator.

REFERENCE SIGNS LIST

1 WORKING IMPLEMENT
2 UPPER SWINGING BODY
3 LOWER TRAVELING BODY
4 DRIVE DEVICE
5 OPERATION DEVICE
6 CAB
6S DRIVER SEAT
7 MACHINE ROOM
8 CRAWLER
9 CONTROL SYSTEM
11 BUCKET
12 ARM
13 BOOM
14 STORAGE BATTERY
15 INVERTER
16 ROTATION SENSOR
17 HYBRID CONTROLLER
18 ENGINE CONTROLLER
19 PUMP CONTROLLER
20 HYDRAULIC CYLINDER
21 BUCKET CYLINDER
21A FIRST BUCKET PASSAGE
21B SECOND BUCKET PASSAGE
21C CAP-SIDE SPACE
21L ROD-SIDE SPACE
22 ARM CYLINDER
22A FIRST ARM PASSAGE
22B SECOND ARM PASSAGE
22C CAP-SIDE SPACE
22L ROD-SIDE SPACE
23 BOOM CYLINDER
23A FIRST BOOM PASSAGE
23B SECOND BOOM PASSAGE
23C CAP-SIDE SPACE
23L ROD-SIDE SPACE
24 TRAVELING MOTOR
25 ELECTRIC SWINGING MOTOR
25B HYDRAULIC SWINGING MOTOR
26 ENGINE
27 GENERATOR
28 OPERATION AMOUNT DETECTING UNIT
29 COMMON RAIL CONTROL UNIT
30 HYDRAULIC PUMP
30A SWASH PLATE
30S SWASH PLATE ANGLE SENSOR
31 FIRST HYDRAULIC PUMP
31A SWASH PLATE
31B SERVO MECHANISM
31S SWASH PLATE ANGLE SENSOR
32 SECOND HYDRAULIC PUMP
32A SWASH PLATE
32B SERVO MECHANISM
32S SWASH PLATE ANGLE SENSOR
33 FUEL ADJUSTING DIAL
34 MODE SELECTING UNIT
40 HYDRAULIC CIRCUIT
41 FIRST PUMP PASSAGE
42 SECOND PUMP PASSAGE
43 FIRST SUPPLY PASSAGE
44 SECOND SUPPLY PASSAGE
45 THIRD SUPPLY PASSAGE

46 FOURTH SUPPLY PASSAGE
47 FIRST BRANCH PASSAGE
48 SECOND BRANCH PASSAGE
49 THIRD BRANCH PASSAGE
50 FOURTH BRANCH PASSAGE
51 FIFTH BRANCH PASSAGE
52 SIXTH BRANCH PASSAGE
53 DISCHARGE PASSAGE
54 TANK
55 JUNCTION PASSAGE
60 MAIN OPERATION VALVE
61 FIRST MAIN OPERATION VALVE
62 SECOND MAIN OPERATION VALVE
63 THIRD MAIN OPERATION VALVE
64 FOURTH MAIN OPERATION VALVE
67 FIRST DIVIDING/MERGING VALVE
68 SECOND DIVIDING/MERGING VALVE
70 PRESSURE COMPENSATING VALVE
80 SHUTTLE VALVE
100 EXCAVATOR (CONSTRUCTION MACHINE)
P1 FIRST BRANCH PART
P2 SECOND BRANCH PART
P3 THIRD BRANCH PART
P4 FOURTH BRANCH PART

The invention claimed is:

1. A drive device of a construction machine including a working implement with a bucket and an arm, comprising:
a bucket cylinder which operates the bucket;
an arm cylinder which operates the arm;
a first hydraulic pump which discharges working fluid supplied to the bucket cylinder and the arm cylinder; and
a hydraulic circuit through which the working fluid discharged from the first hydraulic pump flows,
wherein the hydraulic circuit includes
a first pump passage which is connected to the first hydraulic pump,
a first supply passage and a second supply passage which are connected to the first pump passage,
a first branch passage and a second branch passage which are connected to the first supply passage,
a third branch passage and a fourth branch passage which are connected to the second supply passage,
a first main operation valve which is connected to the first branch passage and the third branch passage,
a second main operation valve which is connected to the second branch passage and the fourth branch passage,
a first bucket passage which connects the first branch passage to a cap-side space of the bucket cylinder through the first main operation valve,
a second bucket passage which connects the third branch passage to a rod-side space of the bucket cylinder through the first main operation valve,
a first arm passage which connects the second branch passage to a rod-side space of the arm cylinder through the second main operation valve, and
a second arm passage which connects the fourth branch passage to a cap-side space of the arm cylinder through the second main operation valve.

2. The drive device of the construction machine according to claim 1,
wherein the working implement includes a boom, and
the drive device further comprises:
a boom cylinder which operates the boom; and
a second hydraulic pump which discharges working fluid supplied to the boom cylinder.

3. The drive device of the construction machine according to claim 1,
wherein the construction machine includes a lower traveling body and an upper swinging body supporting the working implement,
the drive device further comprises:
an electric swinging motor which generates power for swinging the upper swinging body; and
a second hydraulic pump which discharges working fluid supplied to a boom cylinder,
the hydraulic circuit includes
a second pump passage which is connected to the second hydraulic pump,
a third supply passage and a fourth supply passage which are connected to the second pump passage,
a fifth branch passage which is connected to the third supply passage,
a sixth branch passage which is connected to the fourth supply passage,
a third main operation valve which is connected to the fifth branch passage and the sixth branch passage,
a first boom passage which connects the fifth branch passage to a cap-side space of the boom cylinder through the third main operation valve, and
a second boom passage which connects the sixth branch passage to a rod-side space of the boom cylinder through the third main operation valve.

4. The drive device of the construction machine according to claim 3, further comprising:
a junction passage which connects the first pump passage to the second pump passage; and
a first dividing/merging valve which is provided in the junction passage so as to switch a merged state or a divided state of the first pump passage and the second pump passage.

5. The drive device of the construction machine according to claim 1, further comprising:
a second dividing/merging valve which is connected to an outlet port of a shuttle valve provided between the first main operation valve and the second main operation valve.

6. A drive device of a construction machine including a working implement with a bucket, an arm, and a boom, an upper swinging body supporting the working implement, and a lower traveling body, comprising:
a generator;
an electric swinging motor which is operated by power supplied from the generator so as to generate power for swinging the upper swinging body;
a bucket cylinder which operates the bucket;
an arm cylinder which operates the arm;
a boom cylinder which operates the boom;
a first hydraulic pump which discharges working fluid supplied to the bucket cylinder and the arm cylinder;
a second hydraulic pump which discharges working fluid supplied to the boom cylinder; and
a hydraulic circuit through which the working fluid discharged from the first hydraulic pump and the second hydraulic pump flows,
wherein the hydraulic circuit includes
a first main operation valve which adjusts a direction and a flow rate of the working fluid supplied from the first hydraulic pump to the bucket cylinder,
a second main operation valve which adjusts a direction and a flow rate of the working fluid supplied from the first hydraulic pump to the arm cylinder, and a third main operation valve which adjusts a direction and a flow rate of the working fluid supplied from the second hydraulic pump to the boom cylinder, wherein the hydraulic circuit includes a first pump passage which is connected to the first hydraulic pump, a first supply passage and a second supply passage which are connected to the first pump passage, a first branch passage and a second branch passage which are connected to the first supply passage, a third branch passage and a fourth branch passage which are connected to the second supply passage, the first main operation valve which is connected to the first branch passage and the third branch passage, the second main operation valve which is connected to the second branch passage and the fourth branch passage, a first bucket passage which connects the first branch passage to a cap-side space of the bucket cylinder through the first main operation valve, a second bucket passage which connects the third branch passage to a rod-side space of the bucket cylinder through the first main operation valve, a first arm passage which connects the second branch passage to a rod-side space of the arm cylinder through the second main operation valve, and a second arm passage which connects the fourth branch passage to a cap-side space of the arm cylinder through the second main operation valve.

7. The drive device of the construction machine according to claim 6, comprising:

a pressure compensating valve which compensates a pre/post-differential pressure of the first main operation valve and a pressure of the working fluid supplied to the second main operation valve.

8. The drive device of the construction machine according to claim 6, comprising:

an electric drive system which includes the electric swinging motor, wherein the electric swinging motor generates regenerative energy in a deceleration state, and the electric drive system includes a generator, a storage battery which is charged by the regenerative energy generated by the electric swinging motor, and a hybrid controller which controls at least one of the generator, the electric swinging motor, and the storage battery.

* * * * *